US008303439B2

(12) United States Patent
Spallina

(10) Patent No.: US 8,303,439 B2
(45) Date of Patent: Nov. 6, 2012

(54) BASEBALL TRAINING DEVICE AND METHOD

(76) Inventor: Matthew J. Spallina, Carmel, NY (US)

( * ) Notice: Subject to any disclaimer, the term of this patent is extended or adjusted under 35 U.S.C. 154(b) by 212 days.

(21) Appl. No.: 12/903,454

(22) Filed: Oct. 13, 2010

(65) Prior Publication Data

US 2012/0094786 A1 Apr. 19, 2012

(51) Int. Cl.
*A63B 69/00* (2006.01)

(52) U.S. Cl. ..... 473/453; 473/458

(58) Field of Classification Search ..... 473/451, 473/453, 458, 417, 418
See application file for complete search history.

(56) References Cited

U.S. PATENT DOCUMENTS

| | | | | |
|---|---|---|---|---|
| 3,139,282 | A * | 6/1964 | Lande | 473/417 |
| 4,989,866 | A * | 2/1991 | Dill | 473/417 |
| 5,106,085 | A * | 4/1992 | Lewy | 473/417 |
| 5,643,097 | A | 7/1997 | Bechler et al. | |
| 5,879,240 | A | 3/1999 | Stuart | |
| 5,954,598 | A * | 9/1999 | Carlson | 473/458 |
| 6,579,195 | B2 * | 6/2003 | Lamb | 473/417 |
| 6,878,077 | B2 * | 4/2005 | Andrews | 473/453 |
| 7,033,290 | B1 * | 4/2006 | Coldren | 473/453 |
| 7,479,074 | B1 * | 1/2009 | Pierce | 473/417 |
| 2003/0158021 | A1 | 8/2003 | Prichard | |
| 2004/0043824 | A1 | 3/2004 | Uzelac | |
| 2007/0082762 | A1 * | 4/2007 | Falgoust | 473/453 |
| 2007/0243956 | A1 * | 10/2007 | Harris et al. | 473/458 |
| 2008/0085787 | A1 * | 4/2008 | Molloy et al. | 473/417 |
| 2008/0102971 | A1 | 5/2008 | Anderson | |
| 2008/0248900 | A1 * | 10/2008 | Hernandez | 473/453 |
| 2009/0305824 | A1 * | 12/2009 | Sanders | 473/417 |
| 2011/0077109 | A1 * | 3/2011 | Crowley | 473/453 |
| 2011/0190079 | A1 * | 8/2011 | Guevara | 473/417 |

* cited by examiner

*Primary Examiner* — Mark Graham
(74) *Attorney, Agent, or Firm* — Cozen O'Connor

(57) ABSTRACT

A baseball training system to teach proper swing technique comprising a first tee adapted to support a baseball and a second tee adapted to support a baseball, a tee support configured to hold the first tee and a second tee vertically and separated from each other by a horizontal distance, d, a rod, and a belt configured to be worn around a user's stomach and to hold the rod in an approximate horizontal position across the front of the user's stomach.

6 Claims, 4 Drawing Sheets

BASEBALL TRAINING DEVICE AND METHOD

BACKGROUND OF THE INVENTION

The present invention relates to the field of sports training systems and methods, more specifically to the field of baseball swing training.

T-Ball is a sport based on baseball and is intended as an introduction for children to develop baseball skills and have fun. Rather than a pitcher throwing a ball to a batter, in T-Ball the ball is placed on an adjustable tee atop the home plate at a suitable height for the batter to strike and remains there until the batter hits it off of the tee. The bats used in T-Ball are 25" to 26" long, 2¼" diameter, with maximum weight 17 to 20 ounces. A tee ball player swings at a ball resting on the tee.

It is known that correct hip rotation during a swing of a baseball bat is needed to achieve a batter's hitting potential. Although many systems have been suggested to train a batter to hit a baseball correctly and to teach proper hip rotation, none have been widely adopted or have achieved commercial success because of difficulties in setting up the systems, expense, and ineffectiveness in achieving batting swing improvements.

It is an object of the present invention to provide a device and a corresponding method of using such a device which is simple to use, inexpensive, and most importantly effective as a teaching and training method.

SUMMARY OF THE INVENTION

This object, and others which will become apparent from the following disclosure and accompanying drawings, are achieved by the present invention which comprises in one aspect a training system and method to teach a batter to turn his or her hips in the correct fashion when they swing to hit a ball and thus train the batter on how to achieve the batter's maximum potential power.

This invention in one aspect comprises a first tee adapted to support a first baseball and a second tee adapted to support a second baseball, a tee support configured to hold the first tee and a second tee vertically and separated from each other by a horizontal distance, d, a rod, and a belt configured to be worn around a user's stomach and to hold the rod in an approximate horizontal position across the front of the user's stomach. In some embodiments the belt includes a rod supporter which is comprised of a support base and an elastic member, wherein the rod is supported by the tension of the elastic member. In other embodiments the rod is supported on the belt by a cuff or cylindrical receptacle. Other modes of holding the rod in such a position on the belt are possible.

By "rod," I mean any elongated member which can function to strike the ball when the batter rotates the hips, and can be, for example, an actual bat, a cylinder that is shaped like the end of a bat on both sides so that the weight is balanced, a real bat, a half bat which slides into a pipe, a rod-like member which is shaped like the barrel of a bat at one end, and the like.

In another aspect the invention comprises a method of training a batter to swing a bat correctly and efficiently comprising providing two batting tees separated from each other by a distance, d, and a rod supported across the front of the batter's stomach by a belt, arranged so that when the batter swings a bat and hits a ball off of the first tee, which is arranged to be further from the batter than a second tee, the rod turns when the batter's hips turn and if the hips turn ideally the rod strikes a ball held on the second tee.

When a batter starts with most of their weight back, then turns their hips and back foot, this transfers the majority of their body weight into the ball, this will add power to the batter's swing and drive the ball further. By turning the hips fully while making contact with the ball this allows the power of the swing to come from the body and then the arms.

The belt in most embodiments fits around the batter's waist and clips or attaches, preferably on the batter's in the back, but in some embodiments in the front, depending on the system for supporting the rod on the belt. Other embodiments of the belt can be elastic and can be placed over the batter's head or pulled up from below the feet to the waste or stomach area and may or may not have a clip or clips.

The belt can include a support member such as a slip that slides tightly over the belt which helps hold the bat or rod firmly against the stomach of the batter, once the rod has been pushed through the slip. If necessary two straps are then tightened on both sides of the slip around the belt and the bat in order to insure that the bat is securely fastened to the belt and the batter's stomach and hips. The barrel of the bat or the longer side of the rod should be facing the batter's strong side of their body. Once the bat or rod is securely fastened to the batter's body the batter can then start to practice their swing. If the end of the bat or rod crosses the plane that is created by the front hip then the invention is being used correctly. If the end of the bat or rod does not cross the plane before the batter's swing is completed then the batter did not fully rotate his or her hips and therefore did not swing correctly. If a batter does not fully rotate their hips before making contact with the ball then the batter is not using enough of their lower body and body weight to drive the ball which will result in less than the batter's potential drive of the ball.

The belt can be made of any material that is strong enough to support the rod and preferably has buckles or the like to fasten the belt in the back and assure a tight fit to the body. In embodiments with a rod support carried by the belt, the belt slides inside of the slip and the slip rests on the front of the batter across the stomach. The slip has to be able to hold the rod firmly in place so that it does not move around when in use. If using a rod that does not firmly fit into the slip, straps can be applied to both sides of the slip so that it can be tightened down on the belt and the rod. These can be any straps that are sturdy enough to hold the rod in place. The rod is preferably of lighter weight than a conventional bat, but can be similar in weight when light weight bats are used. The rods are shaped like the barrel of a baseball bat or can be a simple tube-like shape. It is important that the rod and rod holder on the belt are sized appropriately so that the rod is held in place by the rod holder on the belt so that there is no unintended movement.

The batter will typically set up a batting tee with a ball on top in the center of their body and get into their hitting stance with or with out a bat in their hands while wearing the batting belt. At this point the batter should have all of his or her weight on their back foot, and will then turn their hips so that the barrel of the rod goes towards the ball and blasts the ball off of the tee. If the batter has hit the ball off of the tee by turning his or her hips then they have used the invention correctly.

Another way to use this batting belt is to have one batting belt, two batting tees, a rod and a bat, and two balls. The two hitting tees should be set up in the center of the batter's body, one very close to the body and the other should be a little further from the body but still in between the batter's two hips. Both tees should have a ball placed on top of them. The batter should take their regular swing and try to hit both balls off of the two tees. The ball on the closer tee will be hit with the rod that is attached to the batting belt and the ball that is further from the body should be hit with the bat that is in the batter's hands. If the batter uses their hips correctly then he or she will hit the closer ball first and the further ball immediately after.

BRIEF DESCRIPTION OF THE DRAWINGS

The description set forth above, as well as other objects, features and advantages of the present invention, will be more fully appreciated by referring to the detailed description and the drawings that follow. The description is of the presently preferred but, nonetheless, illustrative embodiments in accordance with the present invention, when taken in conjunction with the accompanying drawing wherein.

DETAILED DESCRIPTION OF THE PREFERRED EMBODIMENTS OF THE INVENTION

Figure 1:
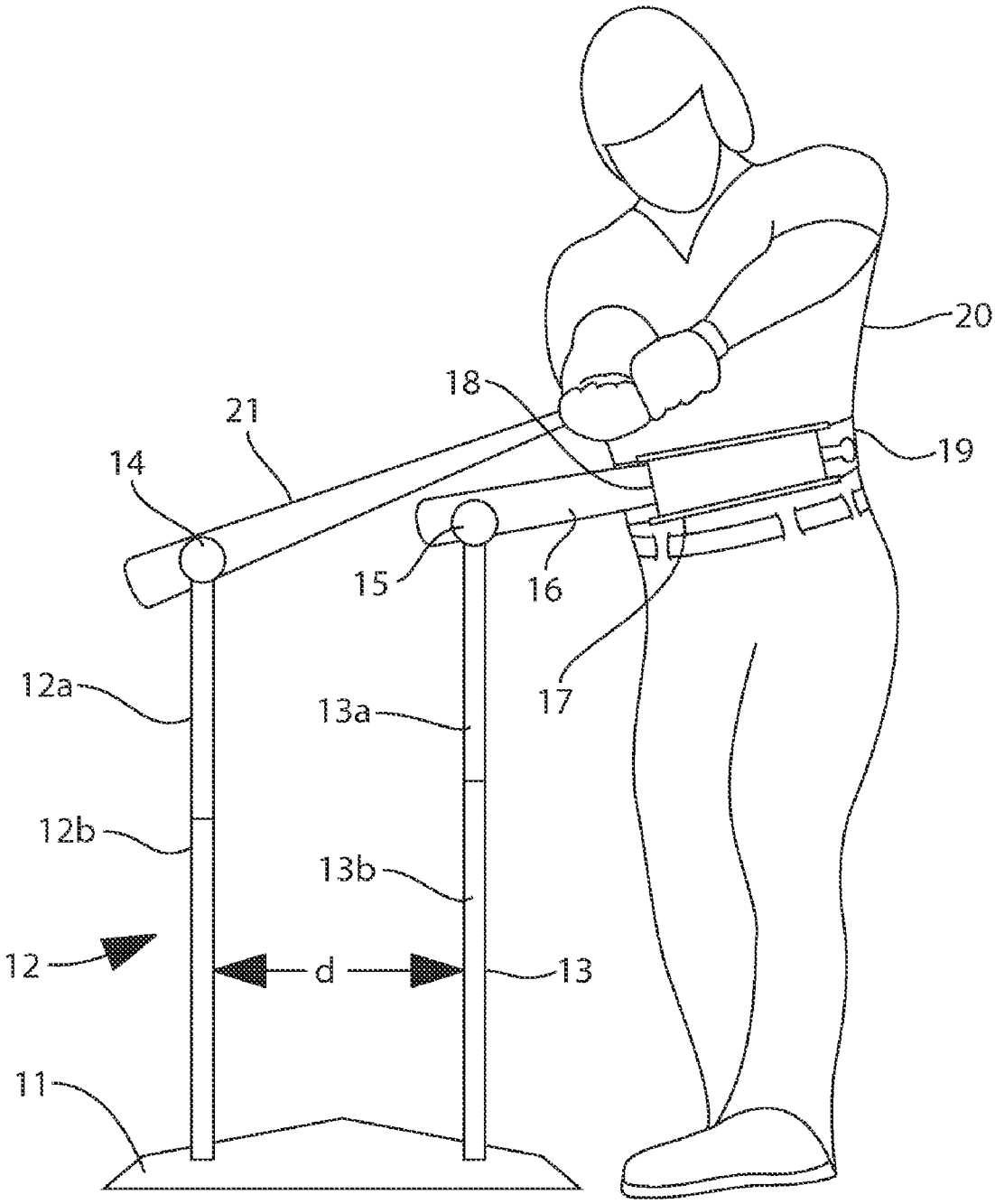
FIG. 1 is a front prospective view of the batting invention with the belt, slip, straps and rod.

Reference is now made generally to FIG. 1 wherein one embodiment of a system according to the invention is shown. Tee support 11, placed on a floor of a gym or outside on the ground, for example, supports first tee 12 and second tee 13, each in a vertical orientation perpendicular to the support and the floor or ground and spaced apart from each other by distance d. Distance d can be from about 12 to 36 inches, preferably about 12 inches when the batter is a child and about 18 inches when the batter is an adult. [is this correct?] In some embodiments the support can have a number of sockets for receiving the tees so that the distance between the tees is selectable, depending on the arm length of the batter.

Tee 12 is adjustable in height in the illustrated embodiment by moving upper tube 12*a*, which fits snugly within lower tube 12*b*, up or down. Tee 13 is also adjustable in height by moving upper tube 13*a* up or down within lower tube 13*b* where upper part is maintained due to the snug fit.

Tee 12 supports baseball 14 and tee 13 supports baseball 15. The baseballs supportable by the tees can be hardballs, softballs, Wiffleballs, of standard or non-standard size, and baseballs 13 and 14 need not be the same type of balls; for example, ball 13 can be a waffle ball and ball 14 can be a hardball.

Rod 16 is illustrated as a conventional baseball or t-ball bat, and be made of plastic, wood, metal, or other material, but is preferably lighter and shorter than a conventional baseball bat. Rod 16 is supported across the front of the stomach of batter 20 by a rod support base 17 and a rod support elastic member 18. Belt 19 holds rod support base 17 in a position across the front of the stomach so that when the rod 16 is inserted between the rod support base 17 and rod support elastic member 18, the rod is maintained horizontally, or close to horizontally, extending to the right or left of the support, depending on whether the batter is batting right or left. In FIG. 1 rod 16 is extending to the right since the batter is batting right.

Figure 2:
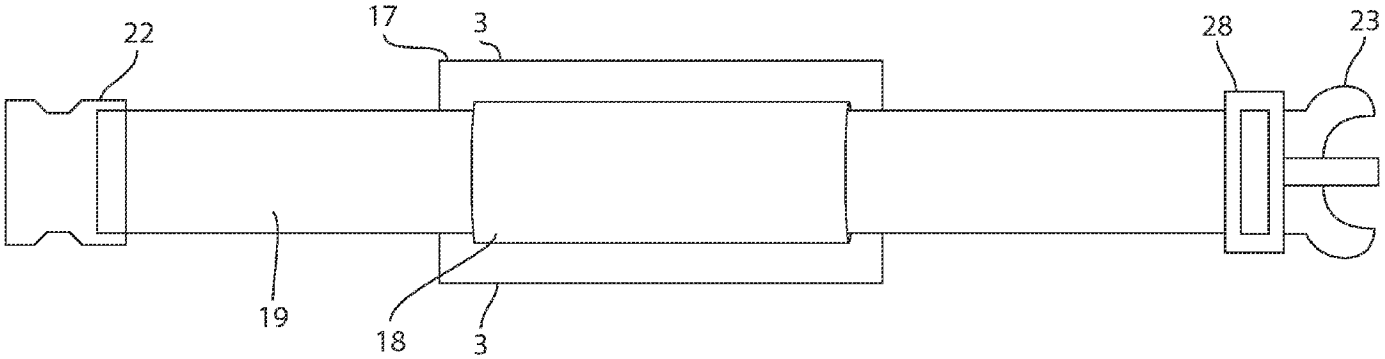
FIG. 2 is a side view of the rod support system.
Figure 3:
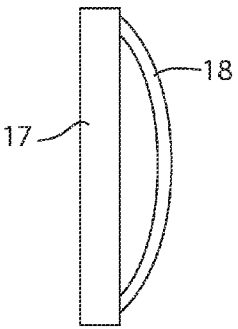
FIG. 3 is an end view of the rod support.

FIG. 2 illustrates the rod support system wherein belt 19, having male buckle 23 at one end and female buckle 22 at the other end of the belt 19, is arranged in front of rod support 17. Rod support elastic member 18 is connected at or near the top and bottom of rod support 17, as illustrated in cross-sectional view in FIG. 3. Belt 19 is adjustable in length with adjuster 28. The belt 19 is of a suitable length to fit around the waist of the intended batter, whether an adult or child.

Figure 4:
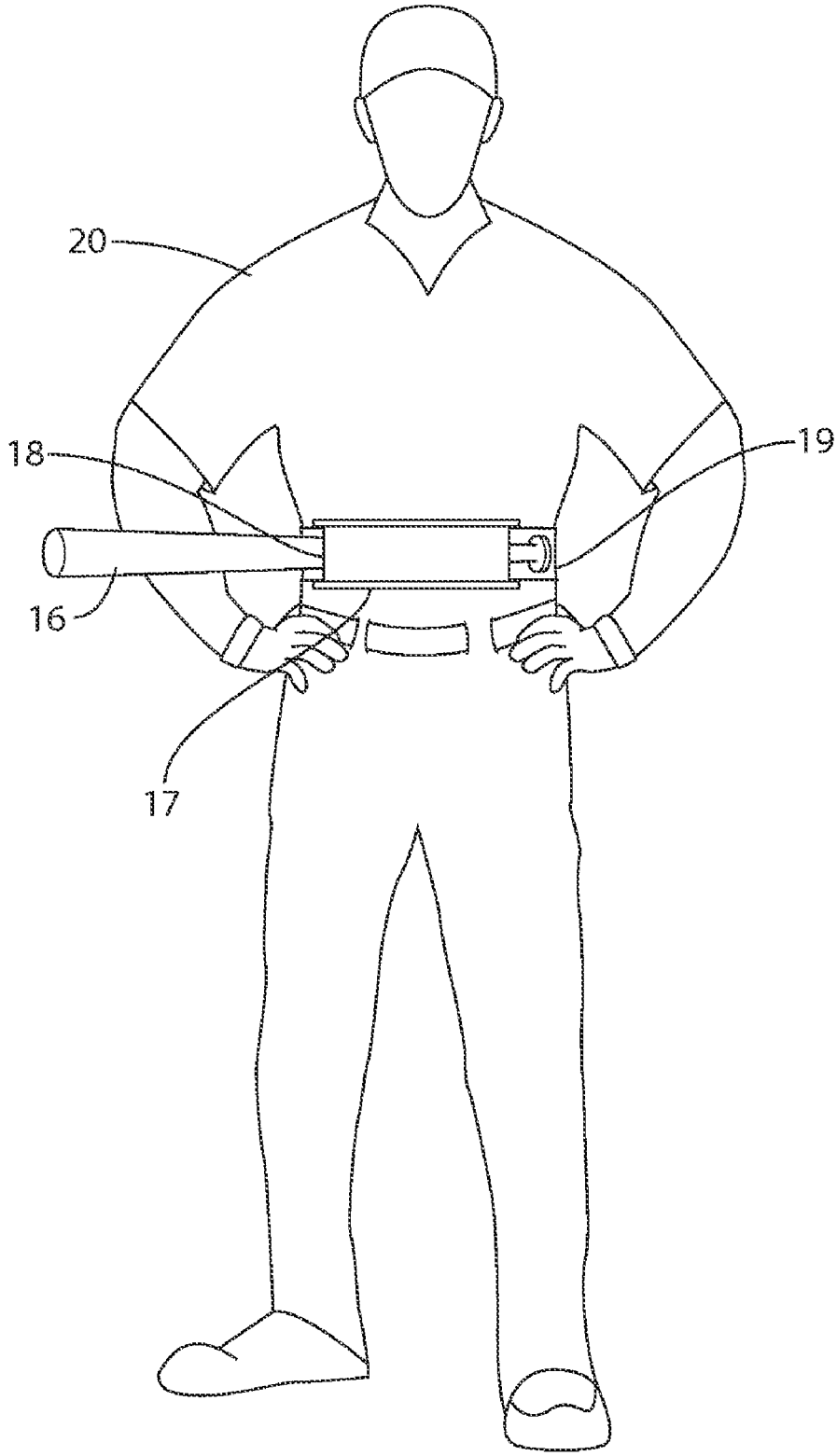
FIG. 4 is a front prospective view of a batter wearing the batting belt with the rod fastened in the slip to the belt.

FIG. 4 illustrates batter 20 wearing the belt 19 wherein rod 16 is supported in horizontal orientation by placing the rod between rod support 17 and rod support elastic member 18.

Figure 5:
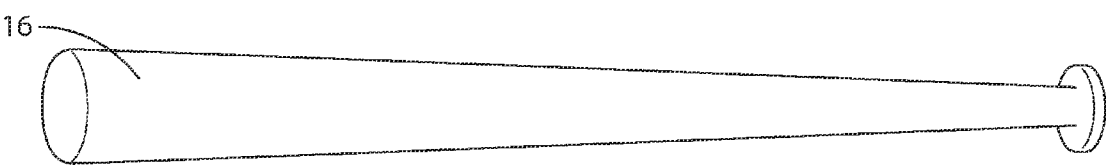
FIG. 5 is a side perspective view of the rod.

FIG. 5 is a perspective view of a rod which is shaped like a baseball bat but is a hollow plastic tube and lighter than a conventional baseball bat.

Figure 6:
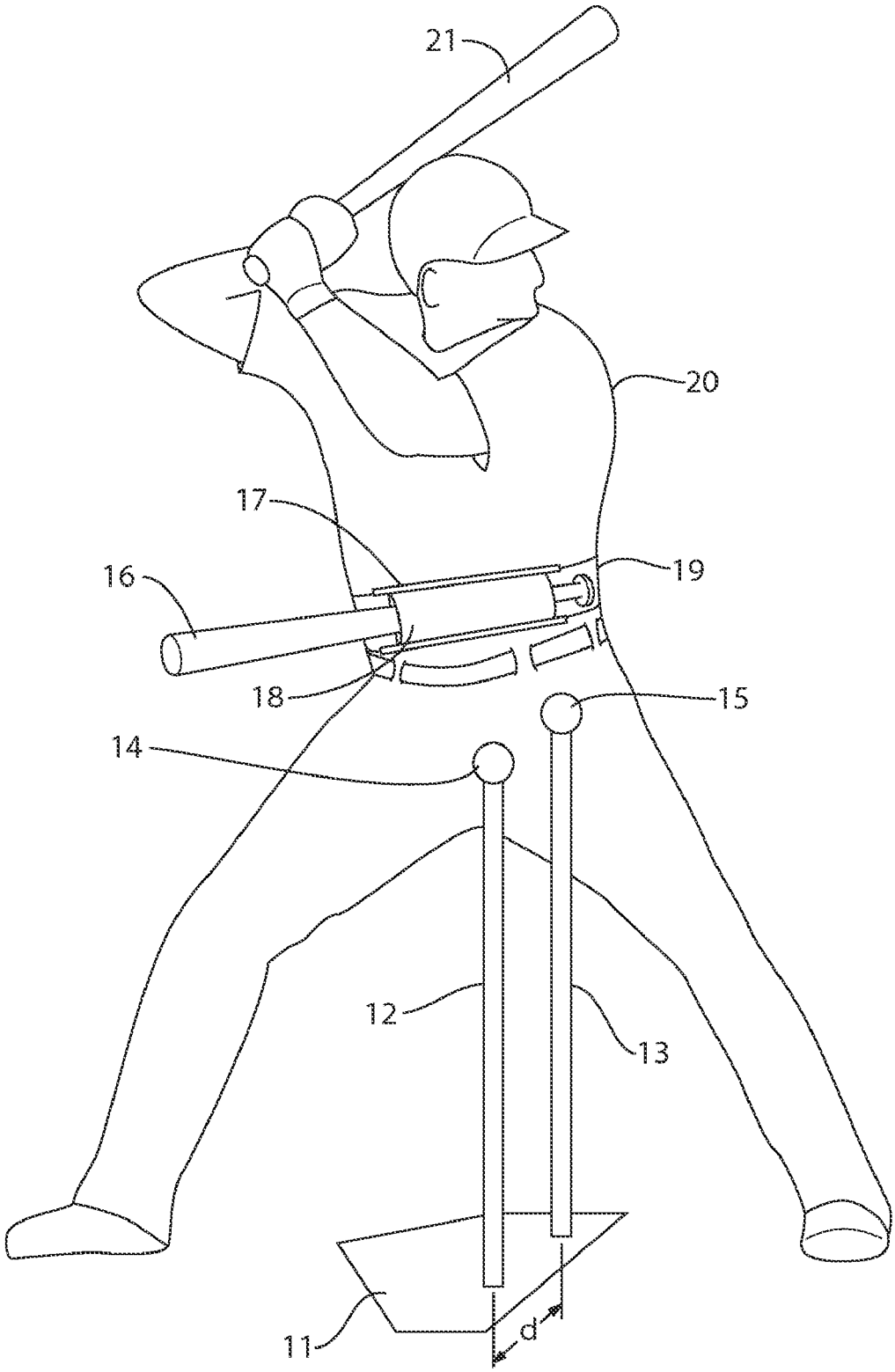
FIG. 6 is a front prospective of the batter executing the baseball swing while wearing the batting belt.

FIG. 6 illustrates a batter about to swing a bat 21 at ball 14 on tee 12. When the batter 20 swings, if the swing is in proper form rod 16 will turn counter clockwise due to hip rotation during follow through and strike ball 15 and hit it off of the tee. With practice, the batter will learn to swing in this fashion so the rod 16 hits ball 15, which is proximal to the batter, and thereby improve his or her swing technique.

One or both balls can be tethered to their respective tee (not illustrated).

Though the invention has been described with respect to a number of embodiments, many additional variations and modifications will immediately become apparent to those skilled in the art. It is therefore the intention that the appended claims be interpreted as broadly as possible in view of the prior art to include all such variations and modifications.

What is claimed is:

1. A system comprising a first tee adapted to support a baseball and a second tee adapted to support a baseball, a tee support configured to hold the first tee and a second tee vertically and separated from each other by a horizontal distance, d, a rod, and a belt configured to be worn around a user's stomach and to hold the rod in an approximate horizontal position across the front of the user's stomach.

2. The system of claim 1 wherein the rod is formed of plastic and is hollow.

3. The system of claim 1 wherein the belt comprises a rod support member and a rod support elastic member which engages the rod support member so that a rod can be received and maintained between the rod support member and the rod support elastic member.

4. The system of claim 1 further comprising two baseballs which are independently selected from a hardball, softball, wiffleball, and t-ball.

5. The system of claim 4 wherein one or both baseballs are tethered to the first tee or second tee.

6. A method of training a batter to swing a bat correctly and efficiently comprising providing two batting tees separated from each other by a distance, d, and a rod supported across the front of the batter's stomach by a belt, arranged so that when the batter swings a bat and hits a ball off of one tee, which is arranged to be further from the batter than a second tee, the rod turns when the batter's hips turn and if the hips turn ideally the rod strikes a ball held on the second tee.

* * * * *